United States Patent [19]

Limbach

[11] 4,182,635

[45] Jan. 8, 1980

[54] METHOD OF HEAT TREATMENT OF DUCTILE METAL STRIP

[75] Inventor: Peter K. F. Limbach, Goettingen, Fed. Rep. of Germany

[73] Assignee: Alcan Research and Development Limited, Montreal, Canada

[21] Appl. No.: 864,469

[22] Filed: Dec. 27, 1977

[30] Foreign Application Priority Data

Dec. 29, 1976 [GB] United Kingdom ..... 54208/76

[51] Int. Cl.[2] ..... B05C 13/10; C21D 9/52

[52] U.S. Cl. ..... 148/130; 118/65; 148/11.5 A; 148/156; 266/102; 432/8

[58] Field of Search ..... 148/130, 2, 131, 3, 148/156, 4, 157, 154, 11.5 RA, 12, 13; 118/59–68, 77; 427/171, 172, 177, 178, 331, 388; 204/37 R, 27, 28; 432/8; 29/527.4; 266/102, 103, 105, 108

[56] References Cited

U.S. PATENT DOCUMENTS

| | | | |
|---|---|---|---|
| 1,704,015 | 3/1929 | Naugle et al. | 148/4 |
| 1,906,211 | 4/1933 | Junker | 432/8 |
| 2,060,634 | 11/1936 | Otis | 432/8 |
| 2,197,622 | 4/1940 | Sendzimir | 118/65 |
| 2,580,406 | 1/1952 | Calton | 118/65 |
| 2,673,080 | 3/1954 | Hepburn et al. | 432/8 |
| 3,312,576 | 4/1967 | Palik | 266/102 |
| 3,682,712 | 8/1972 | Vernier | 148/156 |

*Primary Examiner*—L. Dewayne Rutledge
*Assistant Examiner*—Peter K. Skiff
*Attorney, Agent, or Firm*—Cooper, Dunham, Clark, Griffin & Moran

[57] ABSTRACT

In a process in which strip metal is subjected to heating while suspended as a catenary in a heating zone, the strip is passed into the heating zone in a condition in which the lower surface is slightly elongated in relation to the upper surface. The differential elongation may be due to "coil set" in the strip feed coil or may be applied by a roller leveller or equivalent mechanism during passage from a feed coil to the heating zone. The procedure is conveniently employed to control edge creep and improve flatness in stoving coated strip or in annealing operations.

4 Claims, 5 Drawing Figures

METHOD OF HEAT TREATMENT OF DUCTILE METAL STRIP

The present invention is concerned with treatment of ductile metal strip, in which the strip is subjected to a heating step whilst passing through a heating zone in the form of a catenary.

A typical example of a process to which the present invention applies is the stoving of aluminium strip, coated with a paint film. Another example of a process to which the present invention is applicable is the continuous annealing of aluminium (including aluminium alloy) strip in coated or uncoated form. In the production of painted aluminium strip it is normal practice to apply a paint film to aluminium strip by means of a reverse roller coater. The strip is drawn from a coil, passed through a roller coater which applies a paint film to its upper surface and is then passed through a heating tunnel to stove the paint film. During its passage through the tunnel the strip forms a catenary suspended between rolls located beyond the two ends of the tunnel. Since it is extremely difficult to maintain a uniform transverse temperature profile within a heating tunnel, it is usually found, in stoving painted metal strip, that the temperature attained by the edges of the strip is lower, normally 5–20° C. lower, than at the middle of the strip. The temperature at which painted strip is stoved is typically 150° to 260° C. The temperature at which aluminium is annealed is typically somewhat higher.

In many instances painted aluminium strip, which has been stoved in a heating tunnel, is not as flat as desired and in particular there is a tendency for the strip to be wavy, either at the edges or along the middle. Where aluminium strip in the form of a suspended catenary is annealed by passage through a heating tunnel the same difficulties will occur. It is an object of the present invention to decrease this tendency to waviness.

It is the normal practice in coating aluminium by a roller coater to draw the metal off the top of the coil, so that the paint film is applied to the metal surface, which lay outwardly in the coil.

When metal strip is formed into a coil the outer surface of the strip becomes slightly elongated in relation to its inner surface. When a length of strip is drawn out from the coil by tension, the natural elasticity of the strip leads to a stress differential between the outer and inner surfaces. When the tension is released the strip reassumes longitudinal curvature.

When tension force is applied to straighten the strip, and thereby restrain the longitudinal curvature, the strip assumes a transverse curvature which is convex on its upper surface. When the strip is held under tension as a catenary, depending upon the magnitude of the longitudinal tension the restrained natural longitudinal curvature may not always be sufficient to induce actual transverse curvature. There will in any event be residual transverse bending stresses which will cause redistribution of the longitudinal tensile stresses. As a result, when a length of strip is always held as a catenary after being drawn off the top of the coil, the tendency is always towards an upwardly convex transverse curvature. This will cause the longitudinal tensile stress in the strip along its centre line to be lessened compared with that along its edges assuming that at both ends of the catenary the strip is held essentially flat. In consequence when the strip is softened by exposure to heat, particularly when the temperature is greater at the centre than at the edges, there is a likelihood that the metal will creep at the edges so as to reduce the inequality of the tensile stresses. Creep at the edges of the strip can lead to permanent elongation at these regions and transverse curvature to satisfy the above tendency and, after cooling and release of the strip from longitudinal tension, this results in a wavy appearance at the strip edges.

When the temperature of the strip at its centre line is greater than its temperature at the edges during passage through a heating stage such as stoving or annealing there is differential contraction on cooling after passage through the heating stage. This differential contraction augments the effect of edge creep in giving a wavy appearance to the strip after cooling. From another point of view a higher temperature at the centre than at the edges leads to increase in the creep difference between edges and centre when the tendency to transverse curvature, due to coil set, is upwardly convex on the upper surface of the strip.

In order to avoid the difficulties which arise from passing aluminium or other ductile metal strip through a heating zone having a transverse temperature profile the method of the present invention consists in passing the metal strip through the heating zone in the form of a catenary, having a tendency to transverse curvature which is convex on the underside of the catenary, so that the strip in the catenary would then become longer along its centre than at its edges, considered as a body of uniform temperature. When at uniform temperature in this condition, the tension at the centre line tends to be somewhat greater than at the strip edges.

This expedient has however the effect of reducing the tension inequalities in the heated strip so that the tendency to localised creep is decreased.

The more closely the differential elongation between edges and centre of the catenary in the heating tunnel may be matched with the differential contraction which takes place after exit from the tunnel, the better are the chances of avoiding edge waviness, but even a partial matching, resulting from having the tendency to transverse convex curvature on the underside of the catenary, can lead to significant improvements in the flatness of the product.

The simplest method of achieving the desired tendency to transverse convex curvature on the underside of the strip in the catenary is to draw off the metal strip from the bottom of the coil. However the amount of "coil-set" imparted to metal strip during coiling varies considerably according to the conditions under which coiling is carried out and may thus vary from one coil to another. This difficulty may be overcome to some extent by heat treatment of the coil so as to stabilise the coil-set. After a thermal treatment, the coil-set increases progressively as the coil diameter decreases and there is no expedient for compensating for this difference. Nevertheless it is found that by first heat treating the coil to stabilise the coil-set and then drawing the strip from the bottom of the coil to feed to the roller coater, significant improvements in flatness are obtained. A suitable heat treatment for stabilising the coil-set consists in holding the coil at 180° C. for 2 hours.

It is however well-known that a predetermined amount of coil-set may be imparted to metal strip by means of a roller leveller or three-roll bender devices which are commonly employed for removing "coil-set" or changing longitudinal curvature in metal-strip processing lines. In a roller leveller the metal strip is subjected to multiple bending operations in opposite directions as it is passed through a series of rollers, for example a series of 5 rolls of 80–160 mm diameter. Such a device may be employed for imparting any desired amount of "coil-set" curvature. The same may be achieved by using a 3-roll bender. This permits the elongation of the underside (in the catenary) of the strip in relation to the upper side to be matched rather precisely with the requirements resulting from the non-uniform temperature profile in the heating zone.

In a still further development, the coil-set curvature, imparted by the roller leveller or like device, may be altered automatically in response to temperature signals from the heating zone so that changes in the transverse temperature profile may be automatically matched by a change in the transverse stresses in the strip in the catenary.

Referring to the accompanying drawings.

Figure 1:
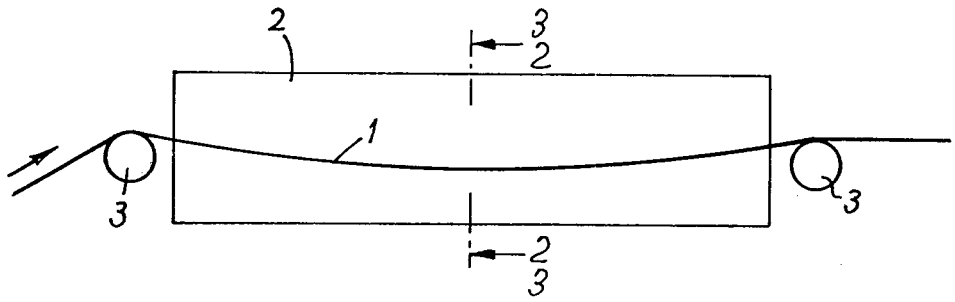
FIG. 1 shows diagrammatically a strip passing in the form of a catenary through a heating tunnel.
Figure 2:
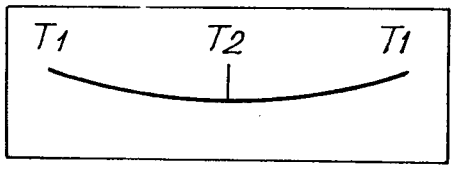
FIG. 2 is an idealised cross-section in accordance with the present invention.
Figure 3:
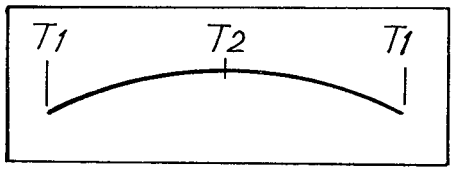
FIG. 3 is a diagrammatic cross-section of the strip at the middle of the catenary when the strip is withdrawn from the coil by overwinding.

FIG. 1 is a diagram showing a strip 1 passing through a heating tunnel 2. The strip is under tension and is supported by rolls 3 outside the heating tunnel. FIGS. 2 and 3 are greatly exaggerated diagrammatic representations of the cross section of the strip at the mid point of the catenary. In the case of FIG. 3 this shape (or a tendency towards this shape) results from "overwinding" from the metal coil (drawing material from the top of the coil so that the inner surface of the strip is on the underside of the catenary). The arrangement shown in FIG. 3 is the undesirable arrangement which can lead to permanent elongation of the strip edges and thus to wavy edges in the final product. FIG. 2 illustrates the desirable arrangement of the present invention, which is particularly helpful in avoiding or reducing edge waviness when the temperature $T_2$ at the centre of the strip is greater than the temperature $T_1$ at the edges.

Figure 4:
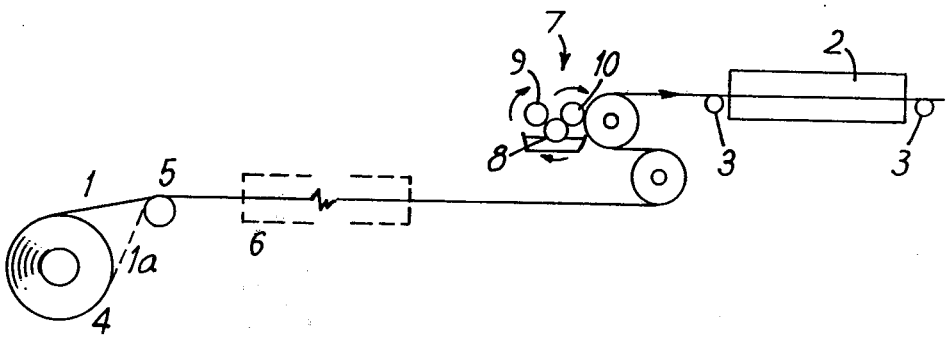
FIG. 4 is a diagram of an apparatus for coating strip in accordance with the invention.

FIG. 4 illustrates a typical arrangement for continuous production of coated strip. Strip 1 is drawn from a supply coil 4, passes over a roll 5 and is drawn through one or more cleaning and pretreatment stages, shown diagrammatically at 6. The strip 1 is then coated by means of a roller coater 7. This may take several forms. In the illustrated example it comprises a take-up roll 8, a metering roll 9 and an applicator roll 10, all turning in the same sense, so that their mutually contacting surfaces are travelling in reverse directions. The surface of the applicator roll 10 is travelling in the reverse direction to the surface of the strip at the point of contact. From the roller coater 7 the strip passes to the heating tunnel 2 to stove the applied coating, so that the material may be coiled after leaving the tunnel.

It will readily be apparent that the outer face of the strip will be coated when the strip 1 is drawn from the top of the coil in the conventional manner. On the other hand, the inner face of the strip will be coated when the strip is drawn out along path 1*a* from the underside of the coil and the transverse curvature, due to coil-set, is on the underside of the catenary within the tunnel 2. It will be understood that when employing the principles of the present invention the strip will be drawn out along the path 1*a*.

Figure 5:
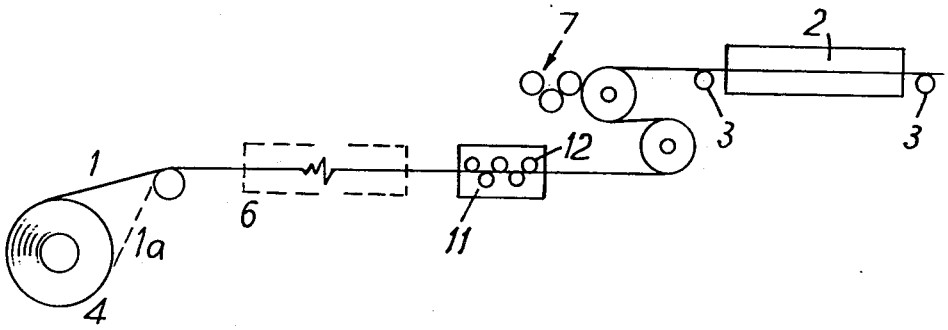
FIG. 5 is a diagram of an alternative apparatus.

In FIG. 5 the system is identical with that of FIG. 4, except that a roller leveller 11 is arranged to act on the pretreated strip before it is coated. The roller leveller 11 consists of a series of small diameter rolls, arranged so that the strip is subjected to a small amount of bending at its point of contact with each roll surface. In the roller leveller the coil-set has been effectively removed before the strip reaches the last roll in the series. The last roll is vertically adjustable so that a desired amount of coil-set may be imparted to the strip as it is bent around this roll, indicated at 12. As already stated the position of the roll may be automatically adjusted in response to temperature measurements made at spaced transverse positions in the heating tunnel. In this instance, since the extent of coil-set curvature is determined by the roll 12, it is unimportant whether the strip is drawn from the top or bottom of the coil.

I claim:

1. A process involving heating aluminium or other ductile metal strip while under tension in the form of a catenary during passage through a heating zone where a higher temperature is produced along the centre line of the strip than along its edges, the improvement which consists in arranging that the metal strip has a tendency toward downwardly convex transverse curvature on the lower side of the catenary so that the tensile stress in the strip is greater on its centre line that at its edges, said tendency to downwardly convex transverse curvature being achieved by drawing the strip from a supply coil in such manner that the outer surface of the strip in the coil lies on the underside of the strip in the catenary so that the tendency to downwardly convex transverse curvature results from the "coil-set" of said supply coil, said process further comprising, before drawing the strip from the coil, the step of subjecting the coil to a heat treatment to stabilize "coil-set".

2. A process according to claim 1 further including applying a coating to the strip surface, which is the upper surface in the catenary, before entry into the heating zone.

3. A process involving heating aluminium or other ductile metal strip while under tension in the form of a catenary during passage through a heating zone where a higher temperature is produced along the centre line of the strip than along its edges, the improvement which consists in arranging that the metal strip has a tendency towards downwardly convex transverse curvature on the lower side of the catenary so that the tensile stress in the strip is greater on its centre line than at its edges, the provision of said tendency to downwardly convex transverse curvature including drawing strip material from a supply coil, subjecting the strip to a multiple bending operation arranged to elongate the side of the strip, which is the underside in the catenary, in relation to the upper side and forwarding the strip to the heating zone.

4. A process according to claim 3 further including applying a coating to the surface of the strip, which is the upper surface in the catenary during passage from the multiple bending operation to the heating zone.

* * * * *